US005755898A

United States Patent [19]

Yamamoto et al.

[11] Patent Number: 5,755,898

[45] Date of Patent: May 26, 1998

[54] SCROLL TYPE COMPRESSOR AND METHOD FOR MANUFACTURING THE SAME

[75] Inventors: Shinya Yamamoto; Takamitsu Mukai; Yasushi Watanabe, all of Kariya; Nobuhiro Ishizaka, Minato-ku, all of Japan

[73] Assignee: Kabushiki Kaisha Toyoda Jidoshokki Seisakusho, Kariya, Japan

[21] Appl. No.: 589,083

[22] Filed: Jan. 23, 1996

[30] Foreign Application Priority Data

Jan. 24, 1995 [JP] Japan ..... 7-009317

[51] Int. Cl.[6] ..... C22C 21/00

[52] U.S. Cl. ..... 148/439; 148/439; 420/534; 420/535; 420/532

[58] Field of Search ..... 420/534, 535, 420/532; 148/439

[56] References Cited

U.S. PATENT DOCUMENTS

| | | | |
|---|---|---|---|
| 4,908,077 | 3/1990 | Nakamura et al. | 148/437 |
| 4,975,243 | 12/1990 | Scott et al. | 420/534 |
| 5,169,462 | 12/1992 | Morley et al. | 148/439 |
| 5,388,973 | 2/1995 | Richardson, Jr. | 418/55.2 |

FOREIGN PATENT DOCUMENTS

| | | | |
|---|---|---|---|
| 508426 | 10/1992 | European Pat. Off. | C22C 1/04 |
| 3817350 | 12/1988 | Germany | B22F 3/02 |
| 650114 | 6/1994 | Japan | F04C 18/02 |

OTHER PUBLICATIONS

Japanese Patent Abstract, JP 6122933, published May 6, 1994.

Japanese Patent Abstract, JP 1273892, published Nov. 1, 1989.

Japanese Patent Abstract, JP 62-126283, published Jun. 8, 1987.

Database WPI, Section PQ, Week 9614, Derwent Publications Ltd., London, GB; Class P52, AN 96-137498 & JP-A-8028493, published Jan. 30, 1996.

Database WPI, Section Ch, Week 9225, Derwent Publications Ltd., London, GB; Class M26, AN 92-205486 & JP-A-4136492, published Nov. 5, 1992.

Database WPI, Section Ch, Week 8728, Derwent Publications Ltd., London, GB: Class M26, AN 87-196561 & JP-A-62127447, published Sep. 6, 1987.

*Primary Examiner*—David A. Simmons
*Assistant Examiner*—M. Alexandra Elve
*Attorney, Agent, or Firm*—Brooks Haidt Haffner & Delahunty

[57] ABSTRACT

Compressor scrolls are made of an aluminum alloy containing 4.0 to 5.0% by weight of Cu, 9.0 to 12.0% by weight of Si, 0.5 to 1.5% by weight of Mg, and 0.6 to 1.0% by weight of Fe. The scrolls are manufactured using a high speed die casting method.

1 Claim, 5 Drawing Sheets

SCROLL TYPE COMPRESSOR AND METHOD FOR MANUFACTURING THE SAME

BACKGROUND OF THE INVENTION

1. Field of the Invention

The present invention relates to a scroll type compressor and its manufacturing method and particularly to a compressor provided with scrolls molded by a high speed die casting method.

2. Description of the Related Art

A typical scroll type compressor is provided with a fixed scroll and a movable scroll. Each of the fixed and movable scrolls has a base plate and a spiral element. The spiral elements of the two scrolls are engaged with each other to define a compression chamber therebetween. The movable scroll orbits around the center axis of the fixed scroll as a shaft, which is coupled to the movable scroll, rotates. This moves the compression chamber from the outer circumferences of the spiral elements to the centers of the spiral elements to compress gas.

Relatively large components, such as a housing which retains the two scrolls, are die cast from an aluminum alloy to decrease the weight of the compressor while maintaining its strength. The scrolls, in particular, are typically manufactured by low speed die casting.

Table 1 shows the typical molding conditions when using a low speed die casting method.

TABLE 1

Molding Condition of Scrolls Formed By Low Speed Die Casting

| Molding Conditions | |
|---|---|
| Metal Material | AC8C (aluminum alloy as defined in JIS H5202) |
| Molten Metal Temperature (°C.) | 700–730 |
| Mold Temperature (°C.) | 150–200 |
| Injection Speed (m/s) | 0.05–0.3 |
| Pressurizing Force (kg/cm$^2$) | 800–1000 |
| Cycle Time (sec.) | 80–100 |

When employing a low speed die casting method, the slow injection speed of the molten metal, and the high pressurizing force against the molten metal prevents air surrounding the mold from entering the mold. Hence, the formation of gas bubbles (air pockets) is suppressed. This produces high-quality scrolls. However, the slow injection speed and the long cycle time results in low productivity and increases manufacturing costs.

High speed die casting is known as a molding method having high productivity. When employing the high speed die casting method to mold scrolls, heat treatment (solution annealing) can not be conducted on the scrolls. This is because the high injection speed draws in a large amount of air into the mold during injection of the molten metal and thus forms gas bubbles in the scroll. When solution annealing is performed on scrolls having air pockets, the air inside the pockets expands. This leads to the formation of blisters in the scrolls, and such scrolls are defective. Therefore, scrolls, which require high strength and wear resistance, are inevitably molded by the low speed die casting method.

SUMMARY OF THE INVENTION

Accordingly, it is an object of the present invention to provide a scroll type compressor and its manufacturing method which enables the scrolls to be formed by the high speed die casting method while ensuring sufficient strength of the scrolls.

To achieve the foregoing object, a scroll type compressor according to the present invention is provided with a fixed scroll and a movable scroll. Each of the fixed and movable scrolls has a base plate and a spiral element. The spiral elements of the two scrolls are engaged with each other to define compression chambers therebetween. Orbital movement of the movable scroll about the center axis of the fixed scroll moves the compression chambers from the outer circumferences to the centers of the spiral elements to compress gas. Each scroll is made of an aluminum alloy which contains 4.0 to 5.0% by weight of Cu, 9.0 to 12.0% by weight of Si, 0.5 to 1.5% by weight of Mg, and 0.6 to 1.0% by weight of Fe.

The invention further includes a method for producing the scrolls through a die casting process.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

Figure 1:
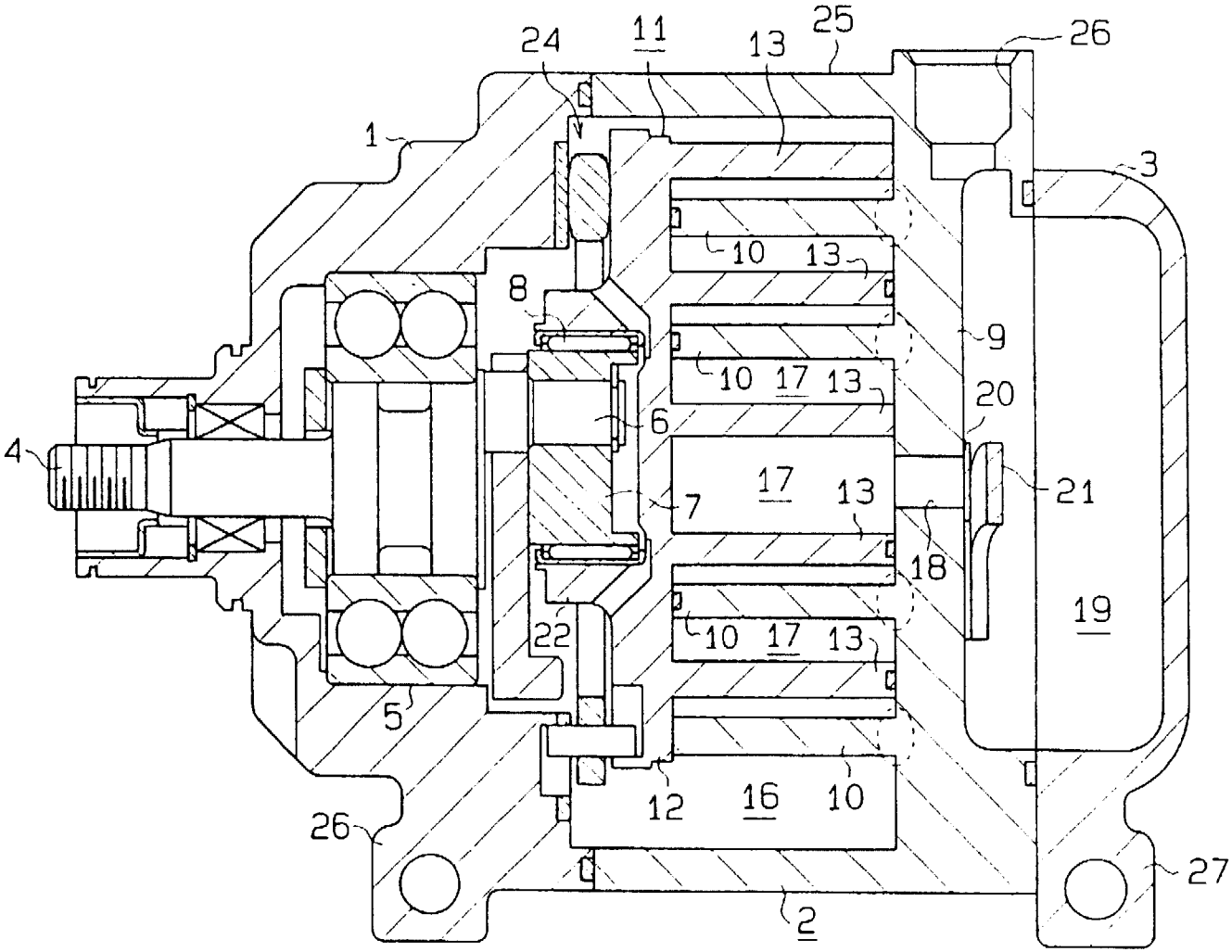
FIG. 1 is a cross-sectional view of a scroll type compressor according to the present invention.
Figure 2:
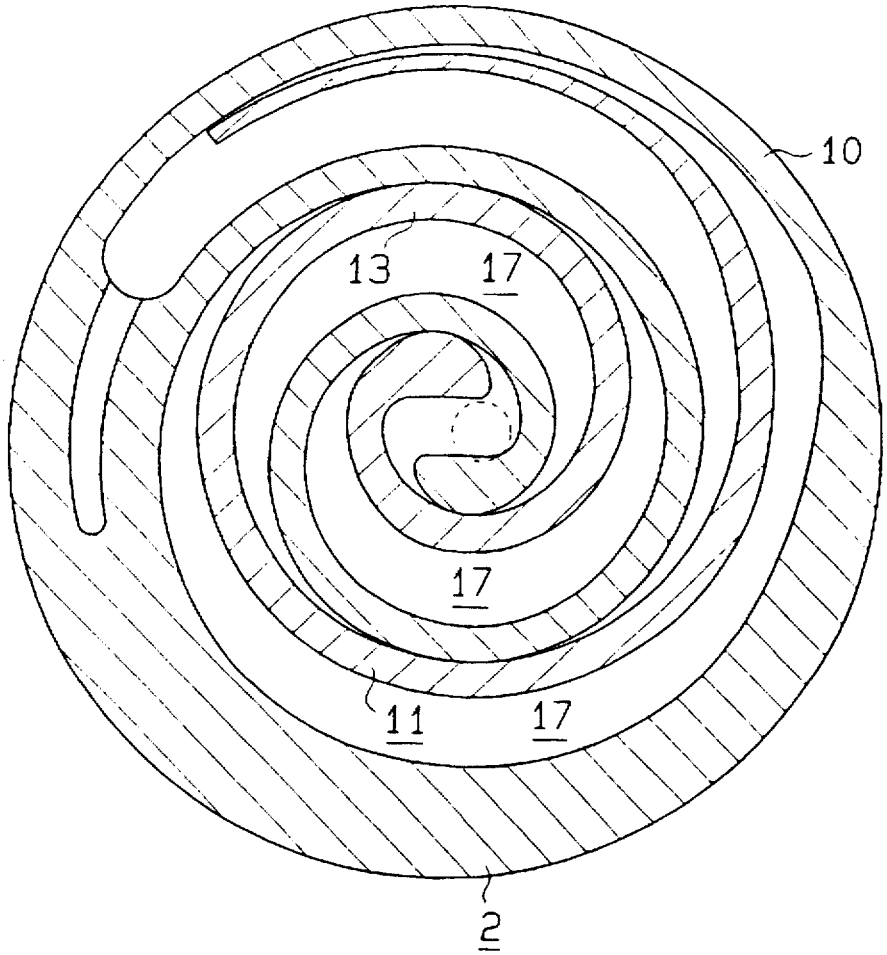
FIG. 2 is a cross-sectional view showing a movable scroll and a fixed scroll of the compressor illustrated in FIG. 1.
Figure 3:
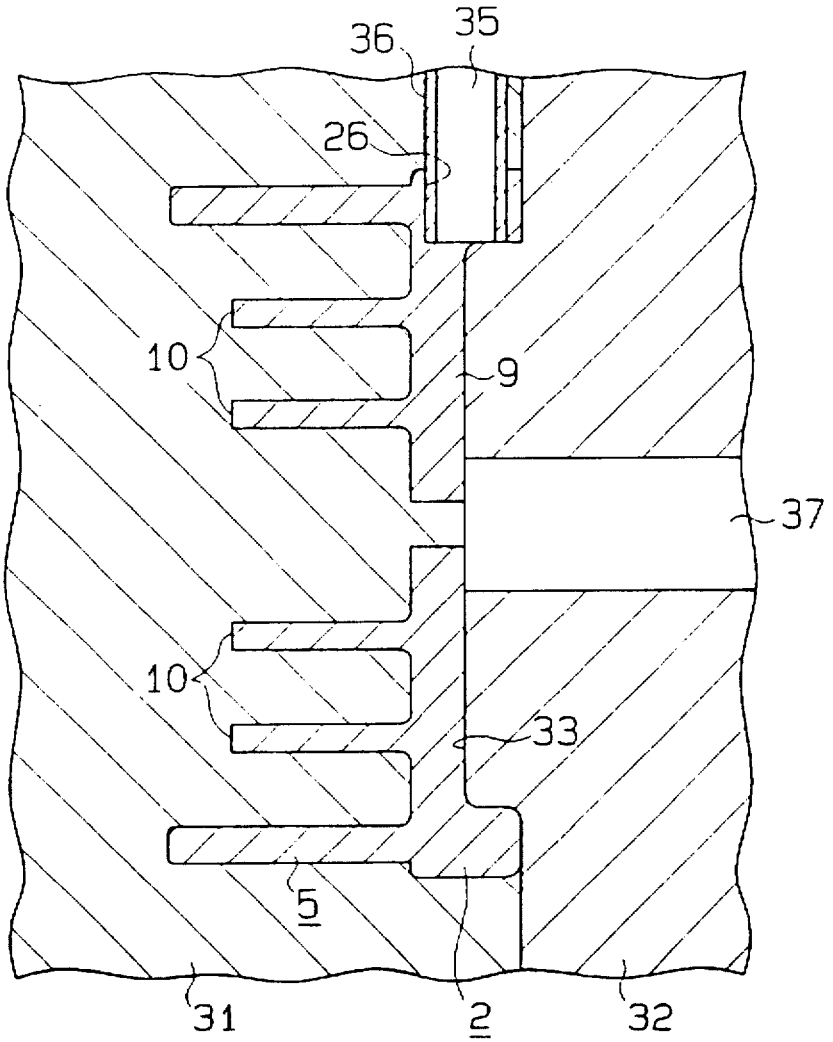
FIG. 3 is a cross-sectional view showing a mold and the scroll during molding of the scroll.

As shown in FIG. 1, a front housing 1 is secured to the front side (left side of drawing) of a fixed scroll 2 by bolts (not shown). A rear housing 3 is secured to the rear side of the fixed scroll by bolts (not shown). A shaft 4 is rotatably supported in the front housing by a main bearing 5. An eccentric pin 6 protrudes from the inner end of the shaft 4. bushing 7 is rotatably and slidably supported by the eccentric pin 6. A bearing 8 is fit onto the bushing 7. The fixed scroll 2 has a base plate 9 and a spiral element 10 formed integrally on the inner side of the plate 9. The outer wall 25 serves as a housing which accommodates the spiral element 10. A movable scroll 11 is accommodated in the front housing 1. The movable scroll 11 also has a base plate 12 and a spiral element 13 formed integrally on the inner side of the plate 12. As shown in FIGS. 1 and 2, the spiral element 10 of the fixed scroll 2 is engaged with the spiral element 13 of the movable scroll 11. The end face of the spiral element 10 contacts the base plate 12 of the movable scroll 11 while the end face of the spiral element 13 contacts the base plate 9 of the fixed scroll 2.

A suction chamber 16, into which refrigerant gas is drawn, is defined at the outer side of the spiral elements 10, 13. A compression chamber 17 is defined between the spiral elements 10, 13. A discharge outlet 18 is formed in the center of the base plate 9 of the fixed scroll 2. The outlet 18 connects the compression chamber 17 with a discharge chamber 19 defined in the rear housing 3. A suction valve 20 is provided at the outer end of the outlet 18. A stopper 21 regulates the opening of the valve 20.

The bushing 7 is supported by the bearing 8 to allow relative rotation with a boss 22. A known anti-rotation mechanism 24 is provided between the front housing 1 and the movable scroll 11. The anti-rotation mechanism 24 prohibits the movable scroll 11 from rotating about its own axis. Rotation of the shaft 4 causes the eccentric pin 6 to move the movable scroll 11 along an orbit around the center axis of the shaft 4 by way of the bushing 7 and the bearing 8. The movement of the movable scroll 11 introduces refrigerant gas into the suction chamber 16 and then compresses the gas in the compression chamber 17. The refrigerant gas is then discharged into the discharge chamber 19 from the discharge outlet 18 and is finally externally discharged from a discharge port 26.

The manufacturing method of the fixed scroll 2 will now be described.

The fixed scroll 2 is molded using a high speed die casting method. The molding conditions of the scroll 2 are shown in Table 2.

TABLE 2

Molding Condition of Scrolls Formed By High Speed Die Casting

| Molding Conditions | |
|---|---|
| Metal Material | Material used in the present embodiment (refer to Table 4) |
| Molten Metal Temperature (°C.) | 700–730 |
| Mold Temperature (°C.) | 150–200 |
| Injection Speed (m/s) | 1–5 |
| Pressurizing Force (kg/cm$^2$) | 700 |
| Cycle Time (sec.) | 60 |

The fixed scroll 2 is formed by first preheating molds 31, 32 to a temperature within the range of 150° to 200° C., preferably at 180° C. As a modification agent (grain refining agent), 0.01 to 0.20% by weight of titanium (Ti) is applied to the molten aluminum alloy (hereafter referred to as molten metal), the temperature of which is within the range of 700° to 730° C., preferably at 700° C. Titanium is preferably added to an aluminum ingot and then both are melted together. The molten metal is then charged into a cavity 33 at an injection speed of 1 to 5 m/s, preferably 5 m/s. The molds 31, 32 are then closed for a predetermined period of time, preferably 20 seconds.

A portion of the molded product is pressurized before the molten metal solidifies in the cavity 33. The sectional pressurization is performed by a first squeeze rod 35 and a second squeeze rod 37 two seconds after the molten metal is injected into the cavity. The first squeeze rod 35 is moved axially in a slide sheath 36 which forms the discharge port 26, and the second squeeze rod 37 is moved axially in a section of the mold 32 that corresponds to the discharge chamber (center portion of the fixed scroll 2) during pressurization of the molten metal. The squeeze rods 35, 37 are moved by hydraulic pressure. The sectional pressurization of these two mold portions by the squeeze rods 35, 37 ensures the supply of molten metal to portions in the cavity 33 where air tends to collect. That is, the portions corresponding to the corners between the spiral element 10 and the base plate 9 (indicated by the dotted line in FIG. 1). Thus, it is possible to enhance the charging ratio of the molten metal inside the entire cavity 33. After sectional pressurization and solidification of the molten metal, the molds 31, 32 are opened to remove the molded scroll 2.

The fixed scroll 2 is rapidly cooled immediately after removing the scroll 2 from the molds 31, 32. In other words, the scroll 2 undergoes a quenching treatment. When the quenching treatment is initiated, the temperature of the scroll is approximately 400° C. This treatment is continued until the temperature of the scroll 2 is lowered to approximately 80° C. from 400° C. The scroll 2 is then heated from 80° C. to approximately 200° C. for about two hours to subject it to an artificial aging treatment. In the next step, the scroll 2 is machined by an NC machine tool to obtain the predetermined shape.

The movable scroll 11 is formed in the same manner as the fixed scroll 2. Sectional pressurization is preferably conducted only at the center portion of the base plate 12 during molding of the movable scroll 11. Nevertheless, if desired, sectional pressurization may be conducted on two portions, as in the same manner with the fixed scroll 2, to enhance the charging ratio.

The scrolls 2, 11 molded in the above manner are made of an aluminum alloy. The composition of this material is shown in Table 3 in comparison with the aluminum alloy used in the prior art.

TABLE 3

Composition of the Alloys Used in the Present Invention and the Prior Art

| | Content Ratio (% by weight) | | | | | | | |
|---|---|---|---|---|---|---|---|---|
| | Cu | Si | Mg | Fe | Zn | Mn | Ni | Al |
| Present Invention | 4.0–5.0 | 9.0–12.0 | 0.5–1.5 | 0.6–1.0 | 0 to 0.03 | 0 to 0.03 | 0 to 0.03 | remainder |
| Preferred Embodiment | 4.5 | 10.5 | 1.0 | 0.8 | 0.03 | 0.03 | 0.03 | remainder |
| AC8C (Prior Art) | 2.0–4.0 | 8.5–10.5 | 0.5–1.5 | 1.0 or less | 0.5 or less | 0.5 or less | — | remainder |

As shown in Table 3, the content ratios of each component in the present invention are as follows: copper (Cu) 4.0 to 5.0% by weight, silicon (Si) 9.0 to 12.0% by weight, magnesium (Mg) 0.5 to 1.5% by weight, iron (Fe) 0.6 to 1.0% by weight, zinc (Zn) 0.03% by weight, manganese (Mn) 0.03% by weight, and nickel (Ni) 0.03% by weight. The remainder is composed by aluminum (Al). Preferable contents of each component are as follows: Cu 4.5% by weight, Si: 10.5% by weight, Mg: 1.0% by weight, Fe: 0.8% by weight, and Zn, Mn and Ni: 0.03% by weight for each.

Table 4 shows the mechanical characteristics of a scroll made from an alloy of the composition of Table 3.

TABLE 4

Mechanical Characteristics of the Scroll

| | |
|---|---|
| Tensile Strength | 240–300 kg/mm$^2$ |
| Brinell Hardness ($H_B$) | 100–120 |
| Coefficient of Thermal Expansion | $2.1 \times 10^{-7}$ |

TABLE 4-continued

| Mechanical Characteristics of the Scroll | |
|---|---|
| Heat Deformation | $1.5 \times 10^{-4}$% or less (180° C. × 100 hrs.) |

Figure 4:
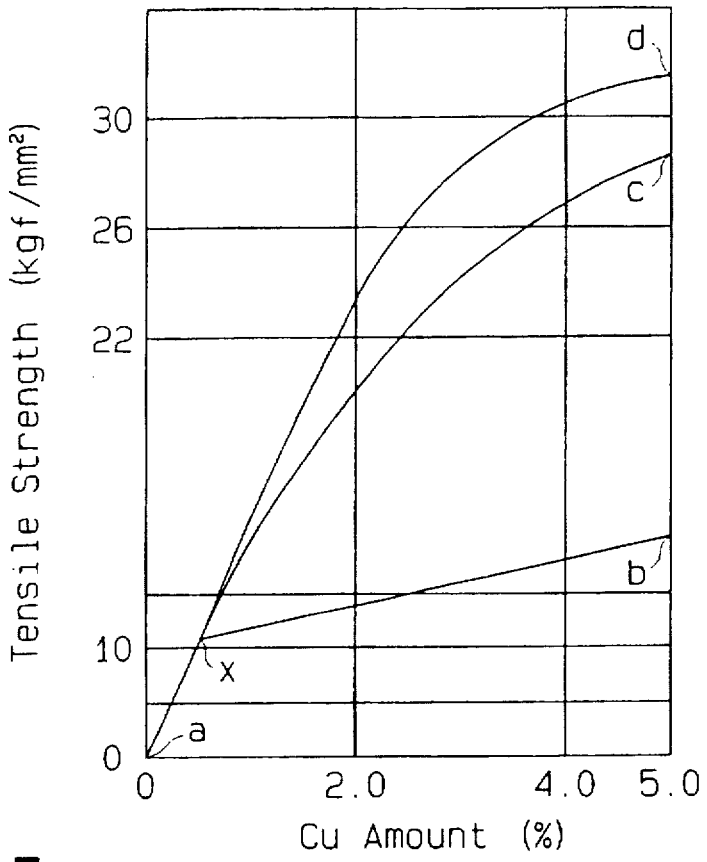
FIG. 4 is a graph showing the mechanical characteristics of an Al—Cu alloy.

FIG. 4 shows a graph illustrating the relationship between the content of Cu and the tensile strength of the scroll when the scroll is molded from an aluminum alloy with 5% or less of Cu applied to Al. The graph also shows the same relationship with heat treatment performed on the scroll after molding and shows changes in tensile strength.

Line a-b in FIG. 4 shows the alteration of tensile strength with respect to the Cu content ratio in a scroll on which slow cooling (annealing) is performed. In the range between a–x, solidification of Cu in Al under normal temperature produces a solid solution. Hence, the tensile strength increases as the content ratio of Cu increases.

In the range between x–b, a compound $CuAl_2$ is produced and thus increases the strength of the molded scroll. Since a higher content of Cu increases the amount of $CuAl_2$, the tensile strength increases along a straight line, which inclines gently.

Line x-c shows the tensile strength of the scroll on which quenching is performed after molding. As the content ratio of Cu increases, the tensile strength increases at a higher rate than when compared to the line x-b. This is because the higher the content ratio of Cu is, the higher the strength of the material as a solid solution becomes when quenching is performed.

Finally, line x-d corresponds to the heat treatment performed on the scrolls 2, 11. Artificial aging is performed on the scrolls 2, 11 by heating them at approximately 200° C. for about two hours after quenching. By comparing line x-d with line x-c, it is apparent that the tensile strength becomes greater when heat treatment is conducted on the molded product. This is because a super-saturated solid solution of Cu produced in Al during quenching is stabilized by the artificial aging, which in turn increases the tensile strength of the super-saturated solid solution.

The term stabilized super-saturated solid solution refers to a state where a phase of Cu solidified in Al and a phase of $CuAl_2$ coexists. Although the phase of $CuAl_2$ does not deposit just by quenching, the two phases exist in the scrolls 2, 11 when artificial aging is performed. This results in the stabilization of the super-saturated solid solution and increases the tensile strength of the scrolls 2, 11.

By forming the scrolls 2, 11 in the above manner, the following effects are obtained.

Sectional pressurization during molding ensures the supply of molten metal to the portions where air pockets tend to form and improves the charging rate of the molten metal into the cavity 33. This reduces the formation of gas bubbles in the scrolls 2, 11 after completion of molding. As a result, it is possible to employ high speed die casting, which has a short cycle time, to mold the scrolls 2, 11 while maintaining sufficient hardness and wear resistance of the scrolls 2, 11. Accordingly, a great reduction in the manufacturing cost of the compressor is possible.

After quenching is performed on the molded scrolls 2, 11, they are artificially aged. This further enhances the strength and hardness of the scrolls 2, 11.

The composition of the aluminum alloy used to mold the scrolls 2, 11 of the present embodiment is as shown in Table 3. Mechanical strength and hardness of the aluminum alloy, or the scrolls 2, 11, are improved by Cu. However, when the content ratio of Cu is lower than 4.0% by weight, the mechanical strength and hardness of the scrolls 2, 11 is insufficient, and when the ratio is higher than 5.0% by weight, the scrolls 2, 11 become brittle.

Flowability of the molten metal during the molding and wear resistance of the molded product are enhanced by Si. However, when the content ratio of Si is lower than 9.0% by weight, the coefficient of thermal expansion becomes large. When the content ratio of Si is higher than 12.0% by weight, the Si crystallizes as primary crystals. This lowers the machinability of the molded product. It also reduces the toughness and fatigue strength of the molded product. Furthermore, when Si exceeds 12.0% by weight, the dissolution temperature of the molten metal becomes high. Therefore, the $H_2$ gas in the air may be absorbed in the molten metal, and oxides may be produced. Thus, there is a possibility that the molded product may become defective during molding.

During artificial aging, Mg causes $Mg_2Si$ to be deposited. This increases the mechanical strength and hardness of the molded product. However, when the content ratio of Mg is lower than 0.5% by weight, the mechanical strength and hardness of the molded product is insufficient. When the content ratio of Mg exceeds 1.5% by weight, there is a tendency of Mg oxides being produced. This lowers the flowability of the molten metal.

Burning and eroding of the molds caused by the molten metal during molding is prevented by Fe. When the content ratio of Fe is lower than 0.6% by weight, the effect of the Fe is insufficient. When the content ratio of Fe exceeds 1.0% by weight, Al—Fe base crystal are produced. This lowers the strength of the molded product.

Furthermore, the aluminum alloy contains 0.03% by weight of Zn, Mn, and Ni each. This improves the strength and toughness of the scrolls 2, 11.

The scrolls 2, 11 are formed of the aluminum alloy containing 4.0 to 5.0% by weight of Cu, 9.0 to 12.0% by weight of Si, 0.5 to 1.5% by weight of Mg, and 0.6 to 1.0% by weight of Fe. Accordingly, it is possible to sufficiently use the characteristics of each element.

In addition, 0.01 to 0.2% by weight of Ti, which acts as a grain refining agent, is applied to the molten metal to refine the crystal grains in the aluminum alloy. Accordingly, the mechanical characteristics of the scrolls 2, 11 are improved, formation of cracks during molding are prevented, and tensile strength is upgraded.

The temperature during artificial aging (approximately 200° C.) of the scrolls 2, 11 is higher than the temperature in the compressor during its operation (approximately 180° C., refer to Table 4). Hence, dimensional change of the scrolls 2, 11 is small. As a result, it is possible to reduce the clearance in the axial direction between the scrolls 2, 11. This reduces the amount of blow-by gas during compression and improves the compressing efficiency.

Figure 5:
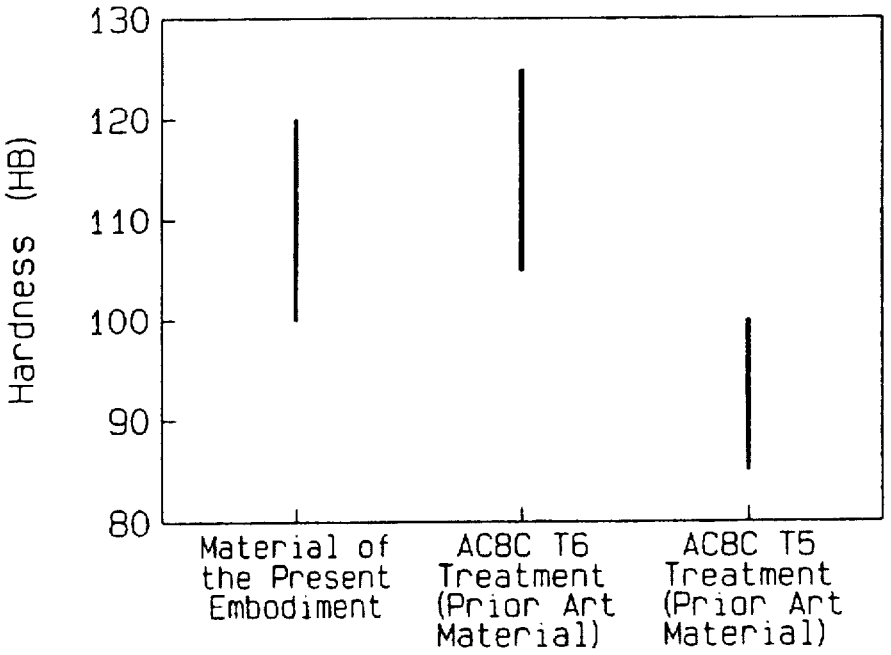
FIG. 5 is a graph comparing the hardness of a molded product made of aluminum alloy according to the present invention, and a molded product made of AC8C prior art material.
Figure 6:
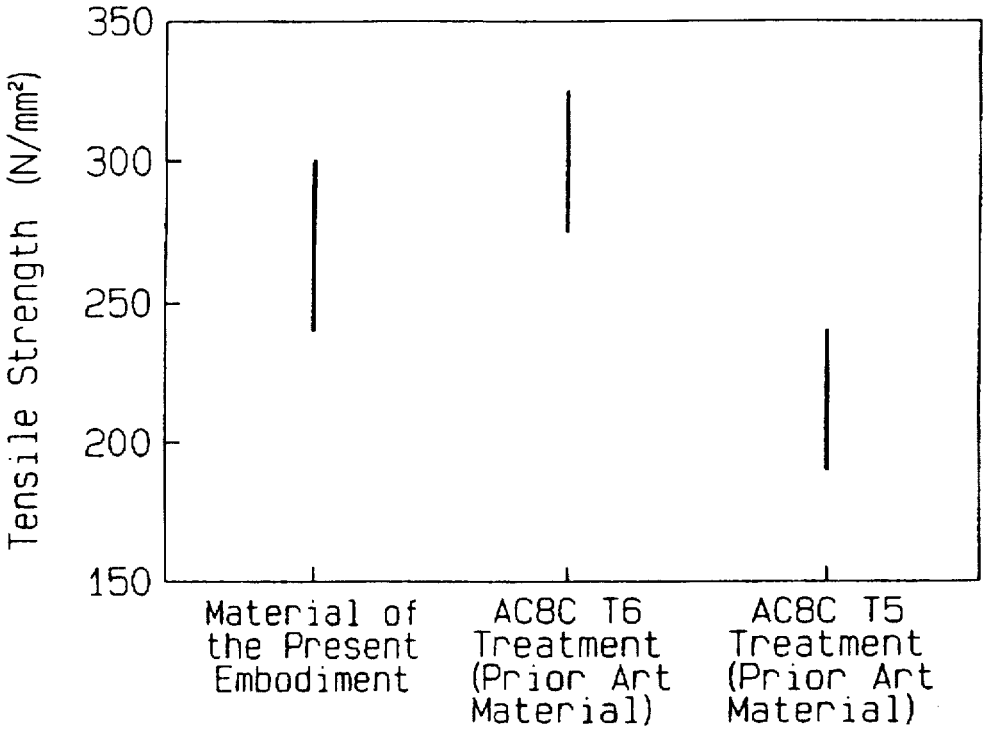
FIG. 6 is a graph comparing the tensile strength of a molded product made of aluminum alloy according to the present invention, and a molded product made of AC8C prior art material.

FIGS. 5 and 6 are graphs comparing the hardness and the tensile strength of a molded product of the present invention and a prior art molded product. In the present invention, quenching and aging treatments are conducted on the scrolls 2, 11 after they are molded from an alloy of the composition shown in Table 3. In the two examples of the prior art, AC8C, which is an alloy material, is used to mold scrolls. A heat treatment defined as T5 and T6 by JIS H5202 is conducted on the scrolls. In the T5 treatment, quenching is not performed on the scrolls. Only artificial aging is performed. In the T6 treatment, after quenching, aging is conducted for a few hours at a temperature between the range of 150° to 180° C.

As apparent from FIGS. 5 and 6, the molded product of the present invention is superior in hardness and tensile strength when compared with a prior art molded product on which T5 treatment had been conducted and has the same hardness as the prior art molded product on which T6 had been conducted.

Although only one embodiment of the present invention has been described herein, it should be apparent to those skilled in the art that the present invention may be embodied in many other specific forms without departing from the spirit or scope of the invention. Particularly, it should be understood that the present embodiment may be modified to the form described below.

(1) The artificial aging may be omitted. In this case, strength, hardness, etc. is low when compared to a scroll which artificial aging has been performed on. However, it is possible to maintain the predetermined strength by performing a quenching treatment on the scroll.

(2) A mixture of Ti and B (Ti: 0.01% by weight to 0.2% by weight, B: 0.001% by weight to 0.005% by weight) may be applied to the molten metal as a grain refining agent instead of applying only Ti. This will enable the same effects to be obtained.

In addition Na (0.001% by weight to 0.01% by weight), Sr (0.01% by weight to 0.05% by weight), and Sb (0.05% by weight to 0.15% by weight) may be applied as a modification agent to modify the needle-like eutectoid silicon into a microscopic particle-like eutectoid silicon. This will enable the same effects to be obtained.

Therefore, the described embodiment is to be considered as illustrative and not restrictive and the invention is not to be limited to the details given herein, but may be modified within the scope of the appended claims.

What is claimed is:

1. A scroll type compressor including a fixed scroll having a base plate and a spiral element, a moveable scroll having a base plate and a spiral element, and compression chambers defined between both spiral elements, wherein a gas is compressed by moving the compression chambers from the outer circumferences to the centers of the spiral elements according to the orbital movement of the moveable scroll around the center axis of the fixed scroll, and wherein each of said scrolls is formed of an aluminum alloy containing 4.0 to 5.0% by weight of Cu; 9.0 to 12.0% by weight of Si; 0.5 to 1.5% by weight of Mg; 0.6 to 1.0% by weight of Fe; 0.03% by weight of each of Zn, Mn and Ni; a grain refining agent including 0.01 to 0.20% by weight of Ti; and one of 0.001% by weight to 0.01% by weight of Na, 0.01% by weight to 0.05% by weight of Sr and 0.05% by weight to 0.151 % by weight of Sb.

* * * * *

UNITED STATES PATENT AND TRADEMARK OFFICE

CERTIFICATE OF CORRECTION

PATENT NO. : 5,755,898
DATED : May 26, 1998
INVENTOR(S) : Shinya Yamamoto et al.

It is certified that error appears in the above-indentified patent and that said Letters Patent is hereby corrected as shown below:

Column 2, line 54, insert the word --A-- before first word "bushing".

Column 8, line 27, change "0.151%" to --0.15%--.

Signed and Sealed this

Third Day of November, 1998

*Attest:*

*Attesting Officer*

Bruce Lehman

BRUCE LEHMAN

*Commissioner of Patents and Trademarks*